United States Patent [19]

Carroll

[11] Patent Number: 5,046,640

[45] Date of Patent: Sep. 10, 1991

[54] STACKED PRE-MOISTENED PAD SEPARATOR

[76] Inventor: Scott M. Carroll, 1301 W. Woodcrest St., Fullerton, Calif. 92633

[21] Appl. No.: 592,265

[22] Filed: Oct. 3, 1990

[51] Int. Cl.[5] ..... B65H 3/22

[52] U.S. Cl. ..... 221/213; 221/312 R

[58] Field of Search ..... 221/213, 210, 27, 37, 221/186, 255, 312 R, 312 C, 259; 206/438, 555, 233

[56] References Cited

U.S. PATENT DOCUMENTS

| | | | |
|---|---|---|---|
| 2,443,520 | 6/1948 | Schwartz et al. | 221/213 |
| 2,864,495 | 12/1958 | Ritchie . | |
| 3,703,977 | 11/1972 | Pisarek | 221/213 |
| 3,970,215 | 7/1976 | McLaren et al. | 221/46 |
| 4,214,673 | 7/1980 | Heath et al. | 221/259 |
| 4,401,233 | 8/1983 | Frey | 221/36 |
| 4,487,318 | 12/1984 | Roen | 206/554 |
| 4,574,952 | 3/1986 | Masui | 206/494 |
| 4,770,320 | 9/1988 | Miles et al. | 221/33 |

*Primary Examiner*—David H. Bollinger
*Attorney, Agent, or Firm*—Gordon K. Anderson

[57] ABSTRACT

A separator for packaged pre-moistened pads which has a round piece of hook closure tape (24) attached with pressure sensitive adhesive (28) to the inside of the lid (22) or (36) of a package container, such as a jar (20) or box (34). The uppermost pad in the stack is impinged and retained on the hooks of the tape (24) when the container is sharply oscillated in opposite directions and is singly separated from the stack when the lid is removed. The hook closure tape is round and offset from the center of the lid to obtain maximum efficiency. Another embodiment locates the hook closure tape (24) on the flat end of a handle (38) picking-up a single pad by simultaneously rotating and exerting pressure on the uppermost pad in the stack housed in a packaged container.

10 Claims, 2 Drawing Sheets

STACKED PRE-MOISTENED PAD SEPARATOR

TECHNICAL FIELD

The present invention relates to stacked premoistened pads encased in an enclosed container in general, more specifically to the addition of hook tape on the inside of the container lid separating a singled pad from the stack.

BACKGROUND ART

Previously, many types of devices have been in use endeavoring to provide an effective means of separating a single piece from a stack of articles in an enclosed container. Much of this art has been directed toward a variety of materials, such as facial tissues, note pads, sheets of paper and particularly moistened tissues for household use. The approach has been as varied as the product dispensed, however, adhesive coating, a mass of adhesive or an adhesive pad have been used to lift the top item from the stack in certain instances.

A search of the prior art did not disclose any patents that read directly on the claims of the instant invention, however, the following U.S. patents were considered related:

| U.S. Pat. No. | Inventor | Filing Date |
|---|---|---|
| 4,770,320 | Miles et al | Sep. 13, 1988 |
| 4,574,952 | Masui | Mar. 11, 1986 |
| 4,487,318 | Roen | Dec. 11, 1984 |
| 4,401,233 | Frey | Aug. 30, 1983 |
| 3,970,215 | McLaren et al | Jul. 20, 1976 |
| 2,864,495 | Ritchie | Dec. 16, 1958 |

Miles et al are concerned with a pressure sensitive substrate on a sheet of material for marking, preferably cellulose acetate. A dispenser package is provided allowing the uppermost sheet to be pulled from the stack through a slot. The adjoining underlying sheet is folded and moved through the slot leaving the next sheet in a position such that it may be pulled through the slot.

Masui is concerned with a box of facial tissues that are interleafed to pull through a slot in the top. The first tissue in the stack is pulled through when the cover over the hole is torn off by the use of strings, tape, clips, magnets, staples, adhesive, or the like. Only the first or uppermost tissue is affected as the interleafing allows the balance of the stack to be sequentially dispensed.

Roen, in U.S. Pat. No. 4,487,318, employs a graspable flap on the outward facing surface of a stack of flat bags. A receptacle includes a tear out panel to gain access to the stack.

Frey, on the other hand, approaches the problem of dispensing a stack of items, such as hair curling end wrap sheets, using a receptacle with a lever resiliently mounted to one end. An opening is provided in the receptacle and the free end of the lever may be pushed down into engagement with the top sheet. The underside of the lever contains a pad of adhesive material allowing the top sheet to adhere to the adhesive and pull the sheet out of the receptacle when released, as the sheet is not porous, the adhesive may be reused.

McLaren et al is concerned with a package for containing and dispensing moistened tissues in a folded stack surrounded by a sealed film wrapper. The wrapper is in a cardboard carton so designed as to allow access to the wrapper. Adhesive tape seals the wrapper and the tissues are removed by hand. No specific dispensing of the top item is taught.

Ritchie employs a roll of paper product material housed in a dispenser which allow the end of the roll to be dispensed through an aperture in the top of the container. The roll has severable sheets allowing the product to be torn off using the opening as the severing means.

It will be noted that the prior art found, has no specific method of grasping the top item in a stack with anything other than adhesive in one form or the other. Using a fastener such as the hook half of VELCRO tape was not found in any such applications.

DISCLOSURE OF THE INVENTION

Most stacked articles may be easily handled by intermeshing the edges or folding the ends over one another and simply pulling through an orifice for access. This method is easily adapted to facial tissues, towels, etc., however, some stacked pads have an entirely different problem, particularly if they are pre-moisturized. The addition of a solution to pre-saturate the pad creates a unique situation in that the solution holds the pads together by capillary action. This problem is accentuated if the pads are made from a soft woven material, such as cotton or a similar synthetic fabric. This is the case in the commercially available pads trademarked TUCKS, which is a pre-moistened pad used for hemorrhoidal and vaginal care manufactured by Parke-Davis div. of Warner-Lambert Co. Other similar products are on the market for the same use and employ similar ingredients. As an example, Park-Davis TUCKS pre-saturate the pads with a solution of 50% Witch Hazel, 10% glycerin and 0.1% sodium citrate with the balance water buffered to an acid PH making the stack very difficult to separate by hand. It appears that users pinch the top pad with their finger and thumb to remove a single item which functions satisfactorily with the first few pads, but after that they are almost inaccessible unless the entire stack is removed and separated using both hands.

It is, therefore, a primary object of the invention to allow removal of the uppermost pad by simply turning the container over or shaking it too and fro then removing the lid and having a single pad affixed to the inside for convenient access. This object is accomplished using a circular piece of hook tape permanently bonded to the inside of the jar lid. The hook tape is the hook portion of the fastener marketed under the trademark VELCRO. This tape contains a series of plastic hooks extending from a woven fabric backing. These hooks are resilient enough to grasp material and hold it tightly until it is removed by hand.

An important object of the invention is the saving of time and frustration removing the pad particularly if the user is in an awkward position.

Another object of the invention allows only one hand to touch the pad and be wetted by the solution. This is particularly advantageous in that the lid is removed from the container using two hands, and when the jar is set down, the pad remains affixed to the lid until removed by the other hand allowing the lid to be loosely replaced on the jar preventing the solution from evaporating while the pad is being used.

Still another object of the invention is directed to physically impaired people with a handicap that affects the use of the hands, such as acute arthritics, etc., where manipulating a stack of pads and pinching the top item would be difficult. Obviously, removing the lid would be the greatest problem, however, the jar lid could be closed but not sealed tightly. At any rate, the handling would be greatly simplified with the invention.

Yet another object is the inherent simplicity of the invention in that only one small element is added to an existing container that creates a far reaching affect in the function while maintaining the containers original purpose. Obviously, this invention is cost effective due to its simplicity and, yet, its effectiveness and benefit is immediately apparent to the user.

A further object overcomes problems created by prior art in similar applications as no adhesive residue is left on the pad nor is the pad contaminated in any way by handling and the device does not wear out or lose its attaching capabilities with age.

It will be noted that the above features may appear to be directed to a specific application for one particular brand of medicated pads, however, this is not necessarily the case, as there are numerous private labels and competitive makes, there are also stacked pre-moistened pads on the market for other uses, such as baby wipes, household cleaning pads and general utility hand wiping. Further, not all pads are stored in round jars, square or rectangular boxes are also employed for this purpose and the invention functions equally well in those applications. Further, the same principle may be applied to attaching the hook closure tape to a handle and simply opening the jar or box and reaching inside and pressing the hooks into the fabric of the pad and twisting, grasping only the top pad for removal.

These and other objects and advantages of the present invention will become apparent from the subsequent detailed description of the preferred embodiment and the appended claims taken in conjunction with the accompanying drawings.

BEST MODE FOR CARRYING OUT THE INVENTION

The best mode for carrying out the invention is presented in terms of a preffered embodiment with the pad grasping main element positioned on the container itself or other items related to a stack of pre-moistened pads.

Figure 5:
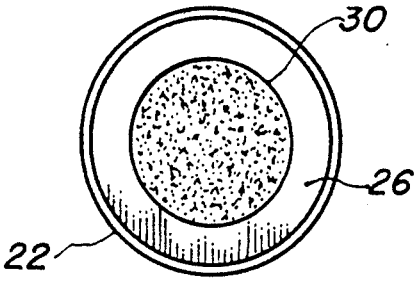
FIG. 5 is the plan view of the inside of a jar lid with the tape in a round embodiment.
Figure 6:
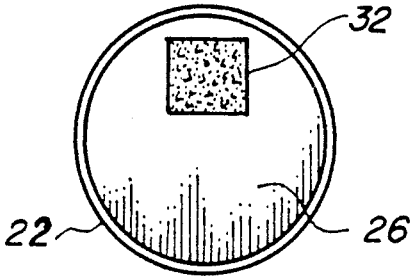
FIG. 6 is the plan view of the inside of a jar lid with the tape in a square embodiment.
Figure 7:
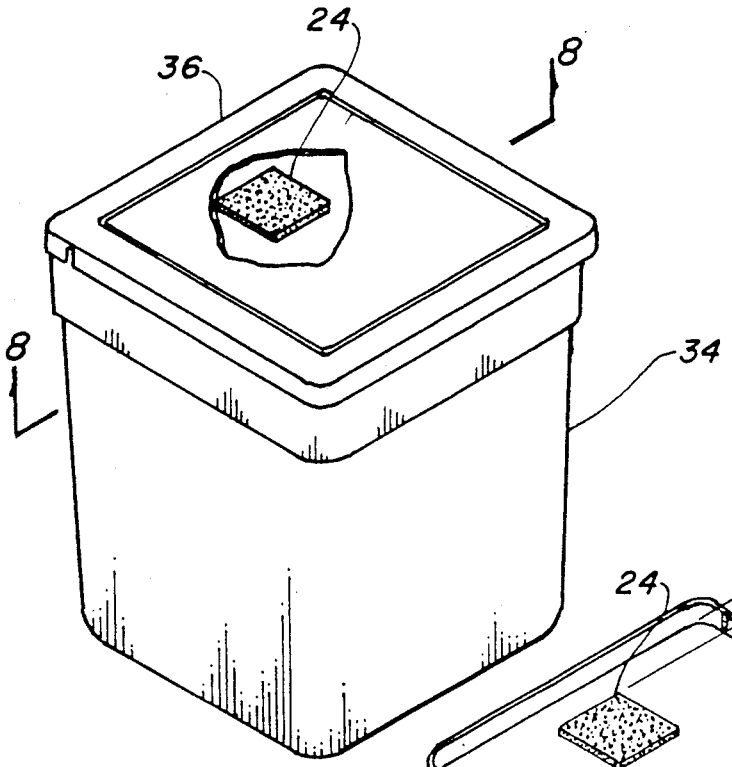
FIG. 7 is a partial isometric view of the preferred embodiment in a box container with the tape illustrated through a cut-away in the lid.
Figure 8:
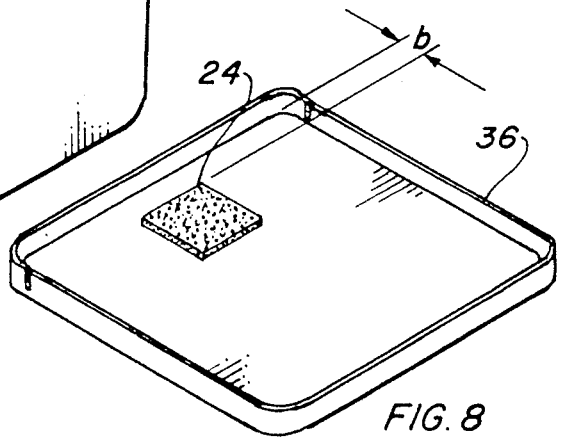
FIG. 8 is a cross-sectional view taken along lines 8—8 of FIG. 7 with the tape location designated "b".
Figure 9:
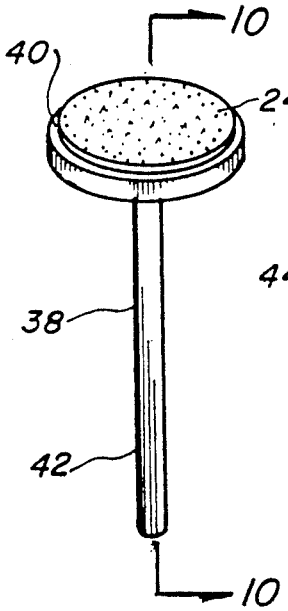
FIG. 9 is a partial isometric view of the preferred embodiment in a two-piece handle embodiment.
Figure 10:
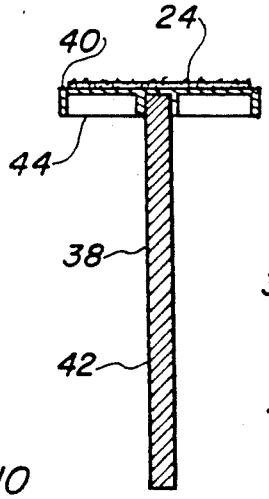
FIG. 10 is a cross-sectional view taken along lines 10—10 of FIG. 9.
Figure 11:
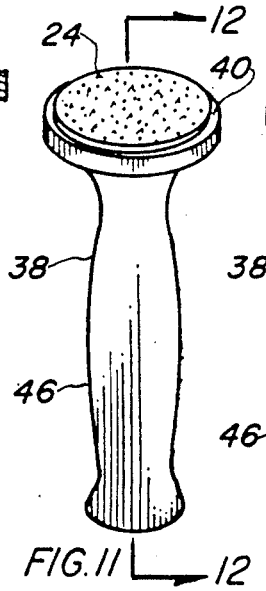
FIG. 11 is a partial isometric view of the preferred embodiment in a single piece handle embodiment.
Figure 12:
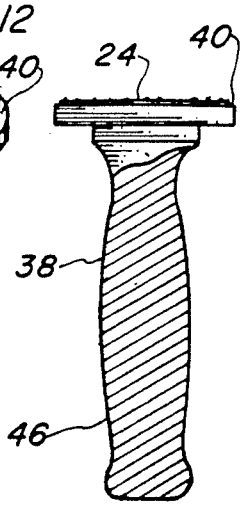
FIG. 12 is a cross-sectional view taken along lines 12—12 of FIG. 11.

The preferred embodiment, as shown in FIGS. 1 through 6 is comprised of a plastic jar, lid, in a box container in FIGS. 7 and 8 and on a handle in FIGS. 9 through 12.

Figure 1:
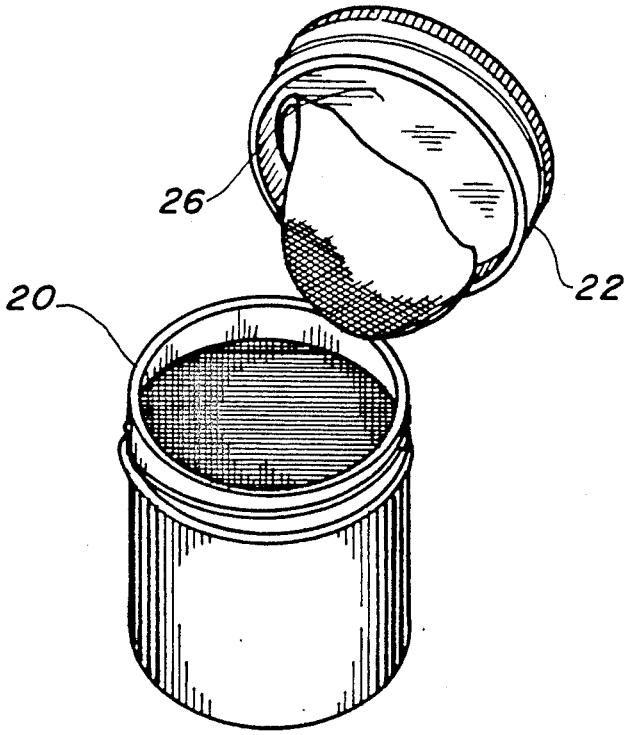
FIG. 1 is a partial isometric view of the preferred embodiment in the jar configuration with the lid removed and the medicated pad separated from the stack.
Figure 2:
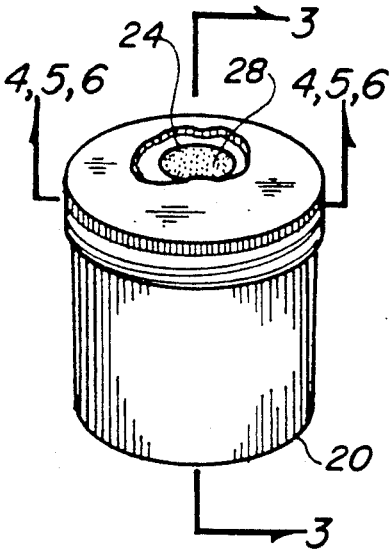
FIG. 2 is a front isometric view of the preferred embodiment with the hook closure tape on the inside of the lid illustrated cut-away.
Figure 3:
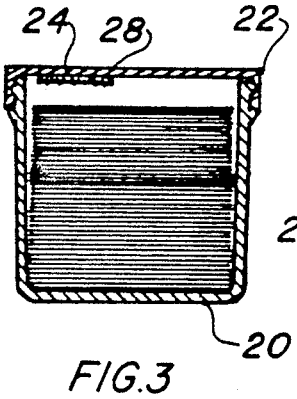
FIG. 3 is a cross-sectional view taken along lines 3—3 of FIG. 2.

FIG. 1 illustrates the invention utilized with a round flat base thermoplastic jar with integral threads, such as employed by Parke-Davis for their TUCKS pre-moistened pads. The jar 20 is utilized with a mating thread screw-on lid 22 with hook closure tape 24 attached to the lid inside surface 26. The tape 24 is smaller than the lid 22 and is the type having a number of thermoplastic hooks extending from a woven fabric. This tape 24 is well known in the art and recognized by its trademark VELCRO, however, only the hook side is employed, as the fibers of the pad are impaled on the hooks, instead of the mating loop tape.

The tape 24 is attached to the inside of the lid 26 with pressure sensitive adhesive 28 that has been added to the back side of the tape 24. Any type of adhesive may be used with equal ease, however, as the VELCRO tape has the pressure sensitive adhesive pre-attached, this method is preferred due to its convenience during the assembly process.

Figure 4:
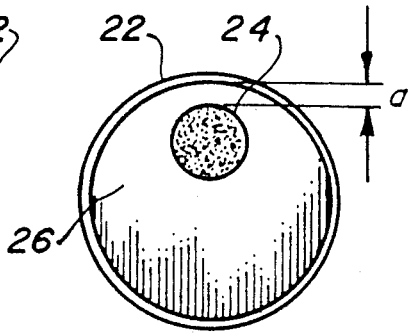
FIG. 4 is a plan view of the inside of a jar lid with the tape location designated "a".

With this particular above described jar 20, it has been found that the pad retension is best obtained using the tape 24 in a round configuration offset from the center of the lid 22. FIG. 4 illustrates this relationship with the offset preferred at a distance 5 to 10 percent of the diameter of the lid. This offset is depicted dimensionally with the letter "a". While other configurations function using the same principles, the optimum size relationship is as shown and described.

FIGS. 5 and 6 illustrate still other acceptable configurations, such as the tape larger in diameter and centered 30 in the lid and almost the same size, further, a square, configuration 32, and offset from the center, is depicted in FIG. 6.

Other types of pads, such as used to wipe babies, household, utility, or to wipe ones hands, are packaged in boxes 34, such as shown in FIGS. 7 and 8. These boxes 34 may be square or rectangular and usually include an integral hinged lid 36 and, like the jar 20, have a flat base. Again, the offset location for the tape 24 is preferred, however, it has been found in the larger boxes that the distance from the edge may vary from 5 to 20 percent of the boxes width, as designated "b" in FIG. 8.

In use, the jar 20 or box 34 is turned upside down and jolted sharply or oscillated in opposite directions causing the pad to be impaled on the hooks of the VELCRO tape 24. When the lid 22 or 36 is removed, the pad remains in contact with the tape 24 as the hooks have sufficient resilience as to bend when the weight of the stack is magnified by the rapid movement where the hooks actually dig into the fibers of the pad. When the lid 22 or 36 is completely removed or hinged away from the container, the single pad is easily grasped and pulled from contact with the tape 24.

The same principle is applied to any size or shape container, also the invention may be used as an after-market device employing the same VELCRO tape 24 and pressure sensitive adhesive 28, except the tape is attached to a handle 38 having an enlarged flat surface 40 on one end. The handle 38 may be in two pieces with a cylindrical hilt 42 and a round holder 44 or a unitary handle 46 with one end round and the handle portion shaped in any form for ease of manipulation. FIGS. 9 through 12 illustrate this embodiment of the invention with the two-piece handle, shown in FIGS. 9 and 10, and the unitary handle depicted in FIGS. 11 and 12. In any event, the VELCRO tape 24 is the same configuration as the round, flat surface 40 of the handle 38 and covers the entire area.

The function of this embodiment differs slightly in that the lid 22 or 36 is removed and the device is inserted inside with the hook tape 24 impinged on the top pad. Slight pressure is exerted while simultaneously rotating the handle securing the hooks of the tape 24 into the fabric of the pad. The device is removed retaining only a single pad on the tape containing flat surface 40 of the handle 34.

While the invention has been described in complete detail and pictorially shown in the accompanying drawings, it is not to be limited to such details, since many changes and modifications may be made in the invention without departing from the spirit and the scope thereof. Hence, it is described to cover any and all modifications and forms which may come within the language and scope of the appended claims.

I claim:

1. A separator for stacked pre-moistened pads packaged in a container with a lid comprising;

a hook closure tape having a plurality of thermoplastic hooks extending from a woven fabric, said tape smaller than the container lid, pressure sensitive adhesive disposed upon the tape on a side opposite the hooks for attachment, and, said tape fixably secured to an inside surface of said container lid with said adhesive, allowing a single pre-moistened pad to be impaled and retained on the hooks when the container is sharply oscillated in opposite directions, causing the pad to be separated from the stack when the lid is removed.

2. The separator as recited in claim 1 further comprising; said container is a thermoplastic jar having integral threads and said lid contains mating threads for attachment thereunto.

3. The separator as recited in claim 2 wherein said thermoplastic jar is round with a flat base.

4. The separator as recited in claim 2 wherein said hook closure tape is round and offset from the center of the lid.

5. The separator as recited in claim 4 wherein the hook closure tape offset from the edge of the lid is 5 to 10 percent of the lid diameter.

6. The separator as recited in claim 1 further comprising; said container is a box having an integral lid.

7. The separator as recited in claim 6 wherein said box is rectangular with a flat base.

8. The separator as recited in claim 6 wherein said hook closure tape is rectangular and offset from the center of the lid.

9. The separator as recited in claim 8 wherein the hook closure tape is offset from the edge of the lid is 5 to 20 percent of the width.

10. A separator for stacked pre-moistened pads packaged in a round thermoplastic container with a screw-on lid comprising;

a hook closure tape having a plurality of thermoplastic hooks extending from a woven fabric round in shape and offset from the center of the inside of the lid from 5 to 10 percent of the lid diameter, pressure sensitive adhesive disposed upon said tape on a side opposite the hooks, for attachment of other objects, and, said tape fixably secured to an inside surface of said container lid, such that a single pad is impaled and retained on the hooks when the container is sharply oscillated in opposite directions, and, when the lid is removed, a single pad is separated from the stack.

* * * * *